US009290869B2

(12) United States Patent
Ueda et al.

(10) Patent No.: US 9,290,869 B2
(45) Date of Patent: Mar. 22, 2016

(54) SEWING MACHINE

(71) Applicants: Daisuke Ueda, Owariasahi (JP); Hiroshi Yamasaki, Nagoya (JP); Toshiyuki Mamiya, Kasugai (JP); Mitsuhiro Iida, Hashima-gun (JP); Kazusa Kondo, Tokai (JP)

(72) Inventors: Daisuke Ueda, Owariasahi (JP); Hiroshi Yamasaki, Nagoya (JP); Toshiyuki Mamiya, Kasugai (JP); Mitsuhiro Iida, Hashima-gun (JP); Kazusa Kondo, Tokai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 130 days.

(21) Appl. No.: 14/185,492

(22) Filed: Feb. 20, 2014

(65) Prior Publication Data

US 2014/0283723 A1 Sep. 25, 2014

(30) Foreign Application Priority Data

Mar. 21, 2013 (JP) ..... 2013-057946

(51) Int. Cl.
*D05B 3/02* (2006.01)
*D05B 55/14* (2006.01)

(52) U.S. Cl.
CPC . *D05B 3/02* (2013.01); *D05B 55/14* (2013.01)

(58) Field of Classification Search
CPC ..... D05B 3/02; D05B 3/025; D05B 55/14; D05B 55/16
See application file for complete search history.

(56) References Cited

U.S. PATENT DOCUMENTS

| | | | | |
|---|---|---|---|---|
| 3,910,161 | A * | 10/1975 | Beckwell | G05B 19/066 91/2 |
| 6,145,457 | A * | 11/2000 | Imaeda | D05B 3/02 112/221 |
| 6,269,760 | B1 * | 8/2001 | Moore | D05B 57/38 112/192 |
| 7,565,873 | B2 * | 7/2009 | Yamasaki | D05B 3/02 112/184 |
| 8,051,788 | B2 * | 11/2011 | Chang | D05B 57/30 112/220 |
| 2008/0216722 | A1 | 9/2008 | Yamasaki | |

FOREIGN PATENT DOCUMENTS

| | | |
|---|---|---|
| JP | A-2006-61594 | 3/2006 |
| JP | A-2008-212383 | 9/2008 |

* cited by examiner

*Primary Examiner* — Danny Worrell
(74) *Attorney, Agent, or Firm* — Oliff PLC

(57) ABSTRACT

A sewing machine includes a needle bar, a needle bar up-and-down movement mechanism, a swinging mechanism, a lower shaft, an outer shuttle, a thread cutting mechanism, a rotation speed adjustment mechanism, and an actuator. The needle bar up-and-down movement mechanism is configured to move the needle bar up and down. The swinging mechanism is configured to swing the needle bar in a left-right direction. The lower shaft is configured to rotate in synchronization with up-down movement of the needle bar. The outer shuttle is configured to rotate along with rotation of the lower shaft. The thread cutting mechanism is configured to cut at least an upper thread. The rotation speed adjustment mechanism is configured to adjust a rotation speed of the outer shuttle. The actuator is a driving source of the thread cutting mechanism and the rotation speed adjustment mechanism.

6 Claims, 14 Drawing Sheets

SEWING MACHINE

CROSS-REFERENCE TO RELATED APPLICATION

This application claims priority to Japanese Patent Application No. 2013-057946 filed Mar. 21, 2013, the content of which is hereby incorporated herein by reference.

BACKGROUND

The present disclosure relates to a sewing machine that includes a swinging mechanism that is configured to swing a needle bar in the left-right direction.

A sewing machine is known which includes a swinging mechanism that is configured to swing a needle bar between a left needle drop position and a right needle drop position so that the sewing machine can form zigzag stitches. When the needle bar is swung by the swinging mechanism, an outer shuttle rotates at a certain rotation speed. Therefore, corresponding to whether the needle bar is located in the left needle drop position or in the right needle drop position, a timing (an encounter timing) at which a hook point, which is provided on the outer shuttle, catches an upper thread loop is different. Specifically, when the needle bar is located in the right needle drop position, the height of an eye of a sewing needle with respect to the hook point at the encounter timing is lower than that when the needle bar is located in the left needle drop position. As a result, when the needle bar is located in the right needle drop position, the upper thread loop is small. Therefore, it is more likely that the hook point cannot reliably hook and catch the upper thread loop. When zigzag stitches are formed, a known sewing machine rotates the outer shuttle at a non-uniform speed and thereby delays the encounter timing when the needle bar is located in the right needle drop position. Thus, even when the needle bar is located in the right needle drop position, the upper thread loop has a favorable size. Therefore, the hook point can reliably hook and catch the upper thread loop. On the other hand, when straight stitches are formed, normally, the needle bar is located in the left needle drop position. Therefore, there is no need for the sewing machine to rotate the outer shuttle at a non-uniform speed. The above-described known sewing machine includes a dedicated pulse motor that is configured to switch whether or not to rotate the outer shuttle at a non-uniform speed, corresponding to whether straight stitches are formed or zigzag stitches are formed.

SUMMARY

When the sewing machine includes the dedicated pulse motor that is configured to switch whether or not to rotate the outer shuttle at a non-uniform speed, a space is required to house the pulse motor. Accordingly, the size of the sewing machine may be increased. Further, the cost of the sewing machine may be increased due to the dedicated pulse motor.

Embodiments of the broad principles derived herein provide a sewing machine that is capable of improving an encounter timing of a sewing needle and a hook point of an outer shuttle, regardless of which needle drop position a needle bar is located in, without increasing the size and cost of the sewing machine.

Embodiments provide a sewing machine that includes a needle bar, a needle bar up-and-down movement mechanism, a swinging mechanism, a lower shaft, an outer shuttle, a thread cutting mechanism, a rotation speed adjustment mechanism, and an actuator. The needle bar is configured such that a sewing needle is attachable thereto. The needle bar up-and-down movement mechanism is configured to move the needle bar up and down. The swinging mechanism is configured to swing the needle bar in a left-right direction. The lower shaft is configured to rotate in synchronization with up-down movement of the needle bar. The outer shuttle is configured to rotate along with rotation of the lower shaft. The outer shuttle includes a hook point. The hook point is configured to catch a loop of an upper thread that is passed through an eye of the sewing needle. The thread cutting mechanism is configured to cut at least the upper thread. The rotation speed adjustment mechanism is configured to adjust a rotation speed of the outer shuttle corresponding to a position of the needle bar in the left-right direction. The actuator is a driving source of the thread cutting mechanism and the rotation speed adjustment mechanism.

BRIEF DESCRIPTION OF THE DRAWINGS

Embodiments will be described below in detail with reference to the accompanying drawings in which.

DETAILED DESCRIPTION

Hereinafter, an embodiment will be explained with reference to the drawings. The present embodiment exemplifies a sewing machine that is configured to form a stitch on a sewing object (a work cloth, for example).

Figure 1:
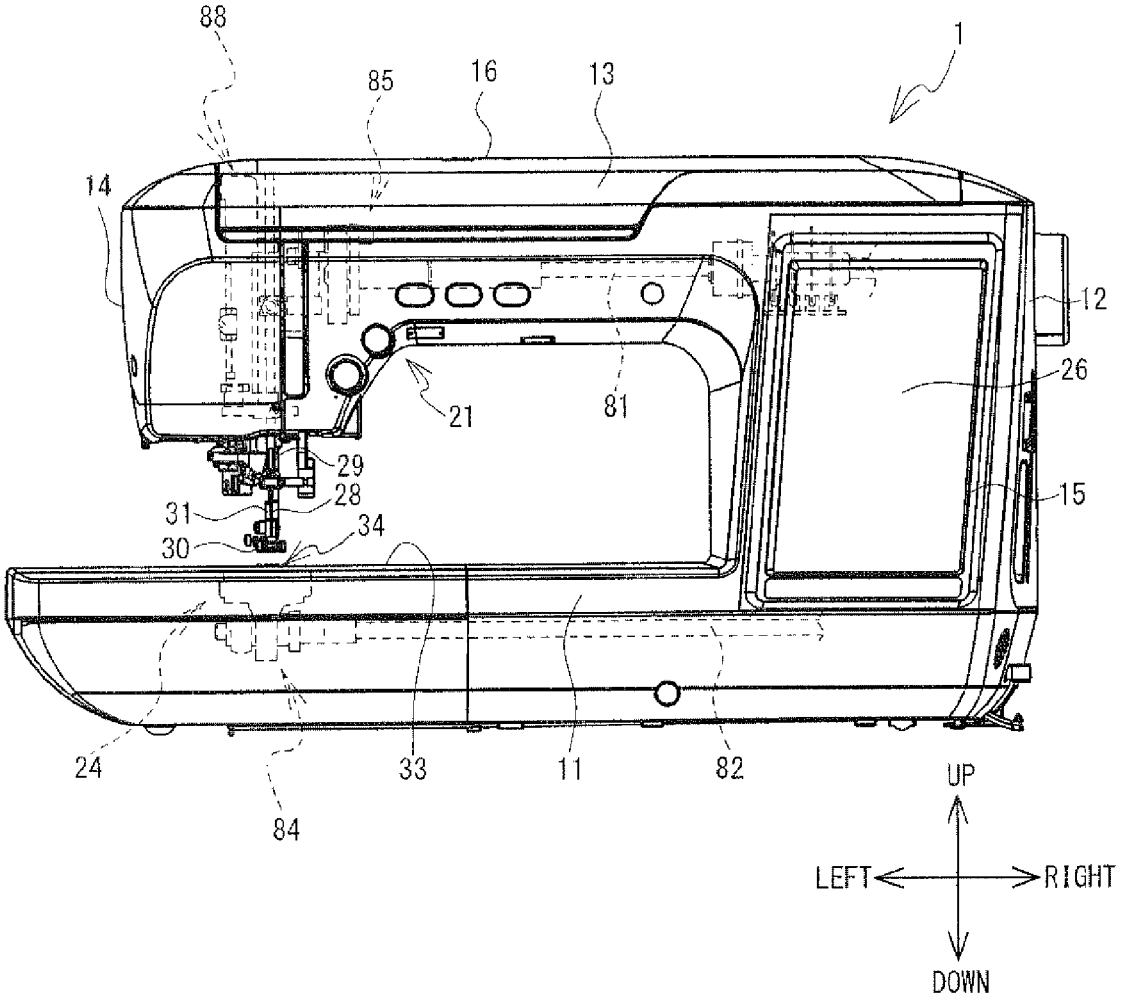
FIG. 1 is a front view of a sewing machine.

First, a physical configuration of a sewing machine 1 will be explained with reference to FIGS. 1 to 12. In the explanation below, the near side, the far side, the upper side, the lower side, the left side, and the right side of FIG. 1 are respectively defined as the front side, the rear side, the upper side, the lower side, the left side, and the right side of the sewing machine 1. That is, the surface on which a plurality of operation switches 21 are arranged is the front surface of the sewing machine 1. The long side direction of a bed 11 and an arm 13 is the left-right direction of the sewing machine 1. The side on which a pillar 12 is arranged is the right side of the sewing machine 1. The direction in which the pillar 12 extends is the up-down direction of the sewing machine 1. The illustration of a base top plate 5 is omitted in FIGS. 3, 6, 9, and 11.

As shown in FIG. 1, the sewing machine 1 mainly includes the bed 11, the pillar 12, and the arm 13. The bed 11 is a base portion of the sewing machine 1 and extends in the left-right direction. The pillar 12 extends upward from a right end portion of the bed 11. The arm 13 extends to the left from the upper end of the pillar 12 such that the arm 13 faces the bed 11. The left end of the arm 13 is a head 14.

Figure 2:
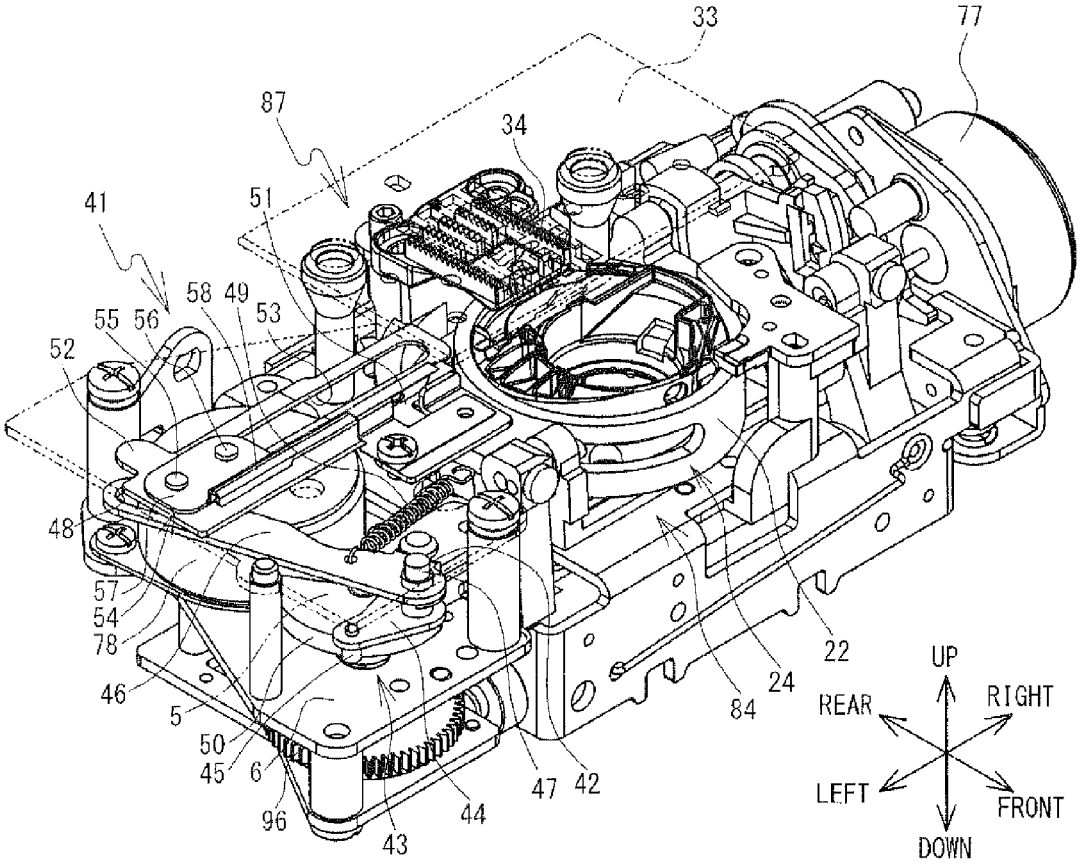
FIG. 2 is a perspective view of a feed mechanism, a shuttle mechanism, and a thread cutting mechanism that are provided inside a bed.

A needle plate 33 is disposed on the top surface of the bed 11. As shown in FIG. 2, a feed dog 34, a feed mechanism 87, a shuttle mechanism 84, a feed adjustment motor 77, a thread cutting mechanism 41, a rotation speed adjustment mechanism 90 (refer to FIG. 4), and an actuator 78 are provided below the needle plate 33 (namely, inside the bed 11). The feed dog 34 is driven by the feed mechanism 87 in synchronization with the rotation of a drive shaft 81 (refer to FIG. 1), which will be described below, and may feed a sewing object (not shown in the drawings) by a predetermined feed amount. The feed amount of the feed dog 34 is adjusted by the feed adjustment motor 77. The shuttle mechanism 84 includes a horizontally rotating shuttle 24, and may interlock the upper thread with the lower thread below the needle plate 33. The horizontally rotating shuttle 24 includes an outer shuttle 22. The outer shuttle 22 is rotated by the shuttle mechanism 84 along with the rotation of a lower shaft 82 (refer to FIG. 1), and includes a hook point 23 (refer to FIG. 8). The hook point 23 can catch a loop of an upper thread T (refer to FIG. 8) that is passed through an eye 25 (refer to FIG. 8) of a sewing needle 28. The lower shaft 82 is driven to be rotated in synchronization with an up-down movement of a needle bar 29. The thread cutting mechanism 41 is configured to cut at least the upper thread. The thread cutting mechanism 41 of the present embodiment is configured to cut the upper thread and the lower thread. The rotation speed adjustment mechanism 90 is configured to adjust a rotation speed of the outer shuttle 22 with respect to a rotation speed of the lower shaft 82 corresponding to a position in the left-right direction of the needle bar 29, which is provided on the head 14. The actuator 78 is a stepping motor, and is a driving source of the thread cutting mechanism 41 and the rotation speed adjustment mechanism 90. The actuator 78 is arranged between the base top plate 5 and a base lower plate 6 in the up-down direction. The shuttle mechanism 84, the rotation speed adjustment mechanism 90, and the thread cutting mechanism 41 will be described in more detail below.

As shown in FIG. 1, a liquid crystal display (LCD) 15 is provided on the front surface of the pillar 12. The LCD 15 may display a screen that includes a variety of items, such as a command, an illustration, a setting value, a message, etc. A touch panel 26 is provided on the front side of the LCD 15. When a user performs a pressing operation of the touch panel 26 using the user's finger, a dedicated touch pen, or the like, which item is selected is recognized corresponding to the pressed position that is detected by the touch panel 26. Hereinafter, the pressing operation of the touch panel 26 that is performed by the user using the user's finger, the dedicated touch pen, or the like will be referred to as a "panel operation." By performing this type of panel operation, the user may select a pattern to be sewn and a command to be executed.

A cover 16 that can be opened and closed is provided on an upper portion of the arm 13. In FIG. 1, the cover 16 is in a closed state. A thread housing portion (not shown in the drawings) is provided below the cover 16, that is, inside the arm 13. The thread housing portion is provided with a thread spool pin (not shown in the drawings), which extends in the left-right direction. A thread spool (not shown in the drawings) is housed in the thread housing portion in a state in which the thread spool is placed on the thread spool pin. A thread guide portion (not shown in the drawings) is provided on the head 14. The upper thread (not shown in the drawings) wound around the thread spool is supplied from the thread spool, via the thread guide portion, to the sewing needle 28 attached to the needle bar 29. The plurality of operation switches 21 including a start/stop switch are provided on a lower portion of the front surface of the arm 13. The drive shaft 81 and a sewing machine motor 79 (refer to FIG. 13) are provided inside the arm 13 and the pillar 12. The drive shaft 81 extends in the left-right direction, and is driven to rotate by the sewing machine motor 79.

The head 14 is provided with the needle bar 29, a presser bar 31, a needle bar up-and-down movement mechanism 85, a swinging mechanism 88, a swinging motor 80 (refer to FIG. 13), and the like. The needle bar 29 and the presser bar 31 extend downward from a lower end portion of the head 14. The sewing needle 28 may be attached to the lower end of the needle bar 29. A presser foot 30 may be detachably attached to a lower end portion of the presser bar 31. The needle bar up-and-down movement mechanism 85 is configured to move the needle bar 29 in the up-down direction. The needle bar up-and-down movement mechanism 85 is driven by the drive shaft 81. The swinging mechanism 88 is configured to swing the needle bar 29 in the left-right direction. With the swinging mechanism 88 of the present embodiment, the maximum distance (amplitude) between the left needle drop position and the right needle drop position is 9 mm. In the present embodiment, when straight stitches are sewn, the needle drop position is the left needle drop position, which is on the leftmost side. The swinging mechanism 88 is driven by the swinging motor 80.

The shuttle mechanism 84, the rotation speed adjustment mechanism 90, and the thread cutting mechanism 41 will be explained in that order with reference to FIGS. 2 to 4. The shuttle mechanism 84 mainly includes a lower shaft gear 91, a shuttle gear 92, and the horizontally rotating shuttle 24. The lower shaft gear 91 is a helical gear. The direction in which the teeth of the lower shaft gear 91 are twisted is the right hand direction (clockwise direction). The lower shaft 82 is extended in the left-right direction and is rotatably supported inside the bed 11. Although details will be described below, the lower shaft gear 91 may be moved in an axial direction of the lower shaft 82 with respect to the lower shaft 82, and may also be rotated together with the rotation of the lower shaft 82. In the present embodiment, the axial direction of the lower shaft 82 is the left-right direction. The shuttle gear 92 is a helical gear that meshes with the lower shaft gear 91. The shuttle gear 92 is rotatably supported by a shuttle shaft (not shown in the drawings), which extends in the up-down direction, and is connected to the outer shuttle 22 of the horizontally rotating shuttle 24. The direction in which the teeth of the shuttle gear 92 are twisted is the right hand direction. The ratio between a pitch circle diameter of the lower shaft gear 91 and a pitch circle diameter of the shuttle gear 92 is 2:1. Therefore, when the lower shaft 82 is rotated once, the outer shuttle 22 is rotated twice. When the outer shuttle 22 is driven to be rotated counterclockwise in a plan view in synchronization with the up-down movement of the needle bar 29, the hook point 23 (refer to FIG. 8) of the outer shuttle 22 may catch the loop of the upper thread T that is formed at the eye 25 (refer to FIG. 8) of the sewing needle 28.

Figure 4:
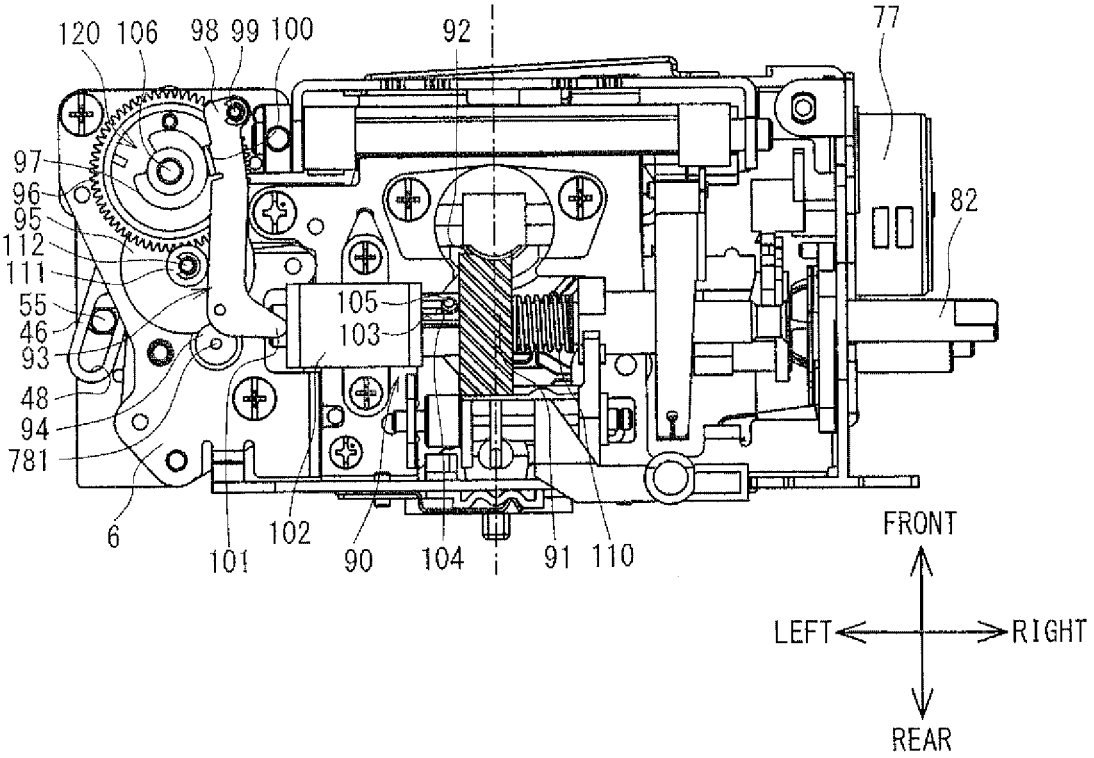
FIG. 4 is a bottom view showing a rotation speed adjustment mechanism when the needle bar is in the left baseline position.

As shown in FIG. 4, the rotation speed adjustment mechanism 90 mainly includes the lower shaft gear 91, the shuttle gear 92, an elastic member 110 and a first transmission mechanism 120. The rotation speed adjustment mechanism 90 includes the lower shaft gear 91 and the shuttle gear 92 in common with the shuttle mechanism 84. The lower shaft gear 91 is urged to the left by the elastic member 110. The elastic member 110 is a coil spring and is disposed around the lower shaft 82. The first transmission mechanism 120 is driven by the actuator 78 and is configured to move the lower shaft gear 91 in the left-right direction. The first transmission mechanism 120 mainly includes a first cam member 97 and a first link member 93.

The first cam member 97 is firmly fixed to a lower portion of a rotation shaft 106, which is extended in the up-down direction. Although not shown in detail in the drawings, the rotation shaft 106 is rotatably supported by the base lower plate 6. The driving force of the actuator 78 is transmitted to the rotation shaft 106 via gears 94, 95, 111, and 96. Specifically, the gear 94 is firmly fixed to an output shaft 781 of the actuator 78. The gear 94 meshes with the gear 95. The gear 111 with a small diameter is integrally formed on a lower portion of the gear 95. The gear 95 and the gear 111 are rotatably supported by a shaft 112, which is fixed to the base lower plate 6. The gear 111 meshes with the gear 96, which is firmly fixed to the rotation shaft 106. Therefore, the first cam member 97 may be rotated by being driven by the actuator 78 via the gear 95 and the gear 111. The illustration of teeth of the gears 94, 95, and 111 is omitted in FIG. 4, and in FIGS. 7, 10, and 12, which will be described below.

The first link member 93 is in contact with the first cam member 97. The first link member 93 may be moved (swung) along with the rotation of the first cam member 97 and thereby may move the lower shaft gear 91 in the left-right direction. The first link member 93 is an L-shaped plate member in a bottom view. A base end portion 98 of the first link member 93 is supported such that the base end portion 98 may be rotated around a shaft 99 that extends in the up-down direction. A leading end portion 101 of the first link member 93 is in contact with a transmission member 102. Although not shown in detail in the drawings, the transmission member 102 is a U-shaped plate member in a front view, and has a left wall portion, a right wall portion, and a bottom portion. Holes are formed in the left wall portion and the right wall portion, respectively, and the lower shaft 82 is inserted through the holes such that the lower shaft 82 may be rotated. The transmission member 102 may be moved in the left-right direction with respect to the lower shaft 82, and is locked by a rotation prevention member (which is not shown in the drawings) such that the transmission member 102 cannot be rotated. The lower shaft gear 91 is integrally formed with an extended portion 103, which extends to the left. The extended portion 103 has a substantially cylindrical shape. The left end of the extended portion 103 is in contact with the right end of the transmission member 102. A long hole 104, which extends in the left-right direction, is formed in the extended portion 103. A pin 105, which is fixed to the lower shaft 82, is inserted through the long hole 104. Due to the pin 105 inserted through the long hole 104, the lower shaft gear 91 may be moved in the left-right direction with respect to the lower shaft 82 and may be rotated together with the lower shaft 82. The elastic member 110 urges the lower shaft gear 91 and the transmission member 102 in the left direction. Thus, the left end of the transmission member 102 and the leading end portion 101 of the first link member 93 are constantly in contact with each other.

A contact portion 100, which is in contact with a cam surface (an outer peripheral surface) of the first cam member 97, is provided on the first link member 93 in a position that is close to the base end portion 98. The leading end portion 101 of the first link member 93 is urged to the left by the elastic member 110. Therefore, the contact portion 100 is constantly in contact with the cam surface of the first cam member 97. When the first cam member 97 is rotated, the contact portion 100, which is in contact with the cam surface of the first cam member 97, is swung in the left-right direction. Due to the swinging movement of the contact portion 100 in the left-right direction, the first link member 93 is swung in the left-right direction. When the first link member 93 is swung in the left-right direction, the lower shaft gear 91 is moved in the left-right direction via the transmission member 102.

Figure 3:
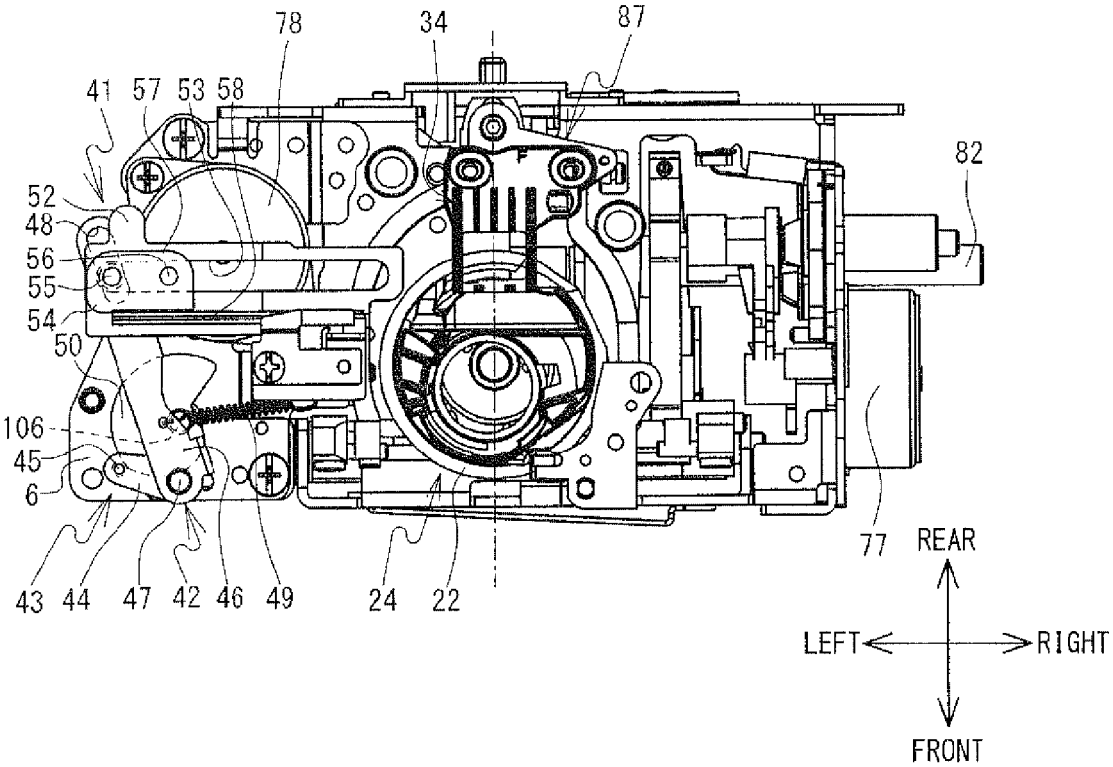
FIG. 3 is a plan view showing a horizontally rotating shuttle and the thread cutting mechanism when a needle bar is in a left baseline position.

As shown in FIG. 3, the thread cutting mechanism 41 mainly includes a guide member 52, a thread catching member 54, and a second transmission mechanism 43. The guide member 52 is a resin member having a thin plate shape that is long in the left-right direction. A long hole 53, which extends in the left-right direction, is formed in the guide member 52. The guide member 52 is firmly fixed to the top surface of the base top plate 5 (refer to FIG. 2). The base top plate 5 has a long through hole having the same shape as the long hole 53. A lower end portion of a cutting blade (not shown in the drawings) is firmly fixed to a right end portion on the front side of the guide member 52. The cutting blade may cut the upper thread and the lower thread in cooperation with the thread catching member 54. The cutting blade is extended in the left-right direction. A cutting portion of the cutting blade is located on a right end portion of the cutting blade.

The thread catching member 54 is a metal member that is extended in the left-right direction. The thread catching member 54 is arranged on the top surface side of the guide member 52. The thread catching member 54 is supported by the guide member 52 such that the thread catching member 54 may be moved between a thread catching position and a cutting position. Although details will be described below with reference to FIG. 11, specifically, the thread catching position is a position in which at least the upper thread can be caught. The cutting position is a position in which at least the caught upper thread can be cut. The thread catching member 54 of the present embodiment is supported such that the thread catching member 54 may be moved between the thread catching position and a standby position. The cutting position is located between the thread catching position and the standby position. The thread cutting mechanism 41 of the present embodiment may catch the lower thread together with the upper thread, and may cut the upper thread and the lower thread.

The thread catching member 54 includes a guide portion 57 and a catching main body 58. The guide portion 57 is extended substantially parallel to an extended surface of the base top plate 5. Guide pins 55 and 56, which extend downward, are provided on the guide portion 57 such that the guide pins 55 and 56 are arranged side by side in the left-right direction. The guide pins 55 and 56 are each internally engaged with the long hole 53 such that the guide pins 55 and 56 may be moved. The catching main body 58 has a linear shape in the left-right direction, and its cross section cut along the front-rear direction has an inverted U-shape. The catching main body 58 includes a catching portion 51 (refer to FIG. 2) at its right end portion. As described above, the cutting blade (not shown in the drawings) is firmly fixed to the guide member 52. The catching main body 58 is disposed in a position where the catching main body 58 may cover the cutting blade. When the thread catching member 54 is moved reciprocatingly in the left-right direction along the long hole 53 of the guide member 52, an inner part of the catching main body 58 does not come into contact with the cutting blade. Since the thread catching member 54 is moved reciprocatingly in the left-right direction in this manner, the lower thread and the upper thread may be caught by the catching portion 51, and then may be cut by the cutting blade.

The second transmission mechanism 43 is configured to move the thread catching member 54. The second transmission mechanism 43 includes a second cam member 50 and a second link member 42. The second cam member 50 may be rotated integrally with the first cam member 97 (refer to FIG. 4). The second cam member 50 is coupled to the rotation shaft 106, and may be rotated along with the rotation of the gear 96 (refer to FIG. 4). As described above, the driving force of the actuator 78 is transmitted to the gear 96 via the transmission mechanism that includes the other gears 94, 95 and 111 shown in FIG. 4. Therefore, the second cam member 50 is driven by the actuator 78 such that the second cam member 50 may be rotated integrally with the first cam member 97.

The second link member 42 is in contact with the second cam member 50. The second link member 42 may move the thread catching member 54 along with the rotation of the second cam member 50. The second link member 42 is arranged between the base top plate 5 and the second cam member 50 in the up-down direction such that the second link member 42 is substantially parallel to the extended surface of the base top plate 5. The second link member 42 mainly includes a lower plate portion 44, a contactor 45, and a top plate portion 46. The second link member 42 has such a shape that the lower plate portion 44 and the top plate portion 46, which extend in mutually different directions, are coupled in the up-down direction. The lower plate portion 44 has an elongated plate shape, and the contactor 45, which extends in the up-down direction, is provided on the leading end side of the lower plate portion 44. The contactor 45 is in contact with a cam surface (an outer peripheral surface) of the second cam member 50. The top plate portion 46 has an elongated plate shape. The base end side of the lower plate portion 44 and the top plate portion 46 is supported such that the lower plate portion 44 and the top plate portion 46 may be rotated around a rotation shaft 47. A long hole 48, which extends in the extension direction of the top plate portion 46, is provided on the leading end side of the top plate portion 46. The guide pin 55 of the thread catching member 54 is inserted through the long hole 48 of the top plate portion 46. An end of an elastic member 49 is fixed to the top plate portion 46. The elastic member 49 is a coil spring. The other end of the elastic member 49 is fixed to the base top plate 5.

The second link member 42 is urged to the right by the elastic member 49. Therefore, the contactor 45 of the lower plate portion 44 is constantly in contact with the cam surface of the second cam member 50. When the second cam member 50 is rotated, the lower plate portion 44 is swung in the substantially front-rear direction along with the rotation of the second cam member 50. Due to the swinging movement of the lower plate portion 44, the top plate portion 46 is swung in the left-right direction. As described above, the guide pin 55 of the thread catching member 54 is inserted through the long hole 48 of the second link member 42. Due to the swinging movement of the top plate portion 46 in the left-right direction, the thread catching member 54 is moved in the left-right direction along the long hole 53.

Figure 5:
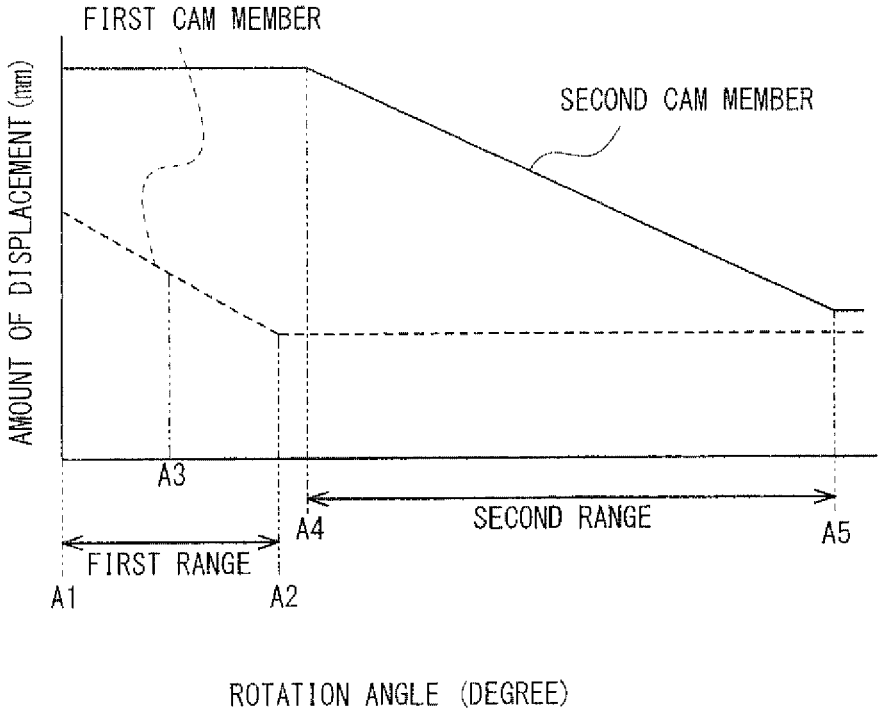
FIG. 5 is a graph schematically showing a relationship between a displacement amount and a rotation angle of a first cam member and a second cam member.

Operations of the thread cutting mechanism 41 and the rotation speed adjustment mechanism 90 will be explained with reference to FIG. 5. In FIG. 5, the horizontal axis shows the rotation angle of the first cam member 97 and the second cam member 50, and the vertical axis schematically shows the amount of displacement (the amount of displacement of the cam surface) of the first cam member 97 and the second cam member 50. The driving range of the actuator 78 includes a first range and a second range which is different from the first range or which partially overlaps with the first range. The actuator 78 drives the rotation speed adjustment mechanism 90 in the first range. The actuator 78 drives the thread cutting mechanism 41 in the second range. In the present embodiment, the first range and the second range are ranges that are different from each other. When the driving range of the actuator 78 is the first range, the rotation angle of the first cam member 97 and the second cam member 50 is in a range between A1 and A2. The rotation angle increases when the rotation shaft 106 is rotated clockwise in a plan view. When the driving range of the actuator 78 is the first range, the first cam member 97 moves the first link member 93, and the second cam member 50 does not move the second link member 42. That is, the second link member 42 is in a stopped state. At this time, the lower shaft gear 91 is moved in the right direction or the left direction by the rotation speed adjustment mechanism 90, and the rotation speed of the outer shuttle 22 with respect to the rotation speed of the lower shaft 82 is adjusted. However, the thread cutting mechanism 41 does not operate.

The operation of the rotation speed adjustment mechanism 90 will be explained in a case where the driving range of the actuator 78 is the first range, that is, in a case where the first cam member 97 and the second cam member 50 are driven in the first range. A case in which the needle bar 29 is in a left baseline position, a case in which the needle bar 29 is in a center baseline position, and a case in which the needle bar 29 is in a right baseline position will be explained as an example. Here, the left baseline position is a position of the needle bar 29 when the position in the left-right direction in a swingable range of the needle bar 29 is on the leftmost side. The right baseline position is a position of the needle bar 29 when the position in the left-right direction in the swingable range of the needle bar 29 is on the rightmost side. The center baseline position is a position of the needle bar 29 when the position of the needle bar 29 is at the center between the left baseline position and the right baseline position. The left baseline position may be defined as a left needle drop position and the right baseline position may be defined as a right needle drop position. As described above, when straight stitches are formed, the needle bar 29 is in the left baseline position.

Figure 7:
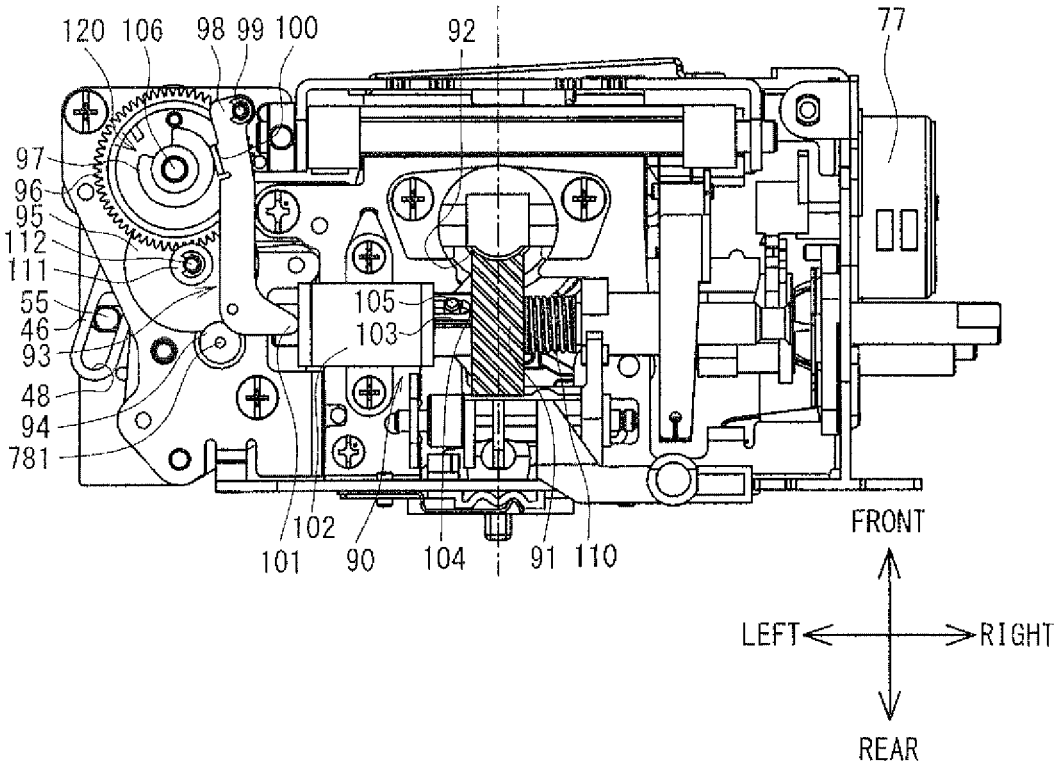
FIG. 7 is a bottom view showing the rotation speed adjustment mechanism when the needle bar is in the center baseline position.
Figure 10:
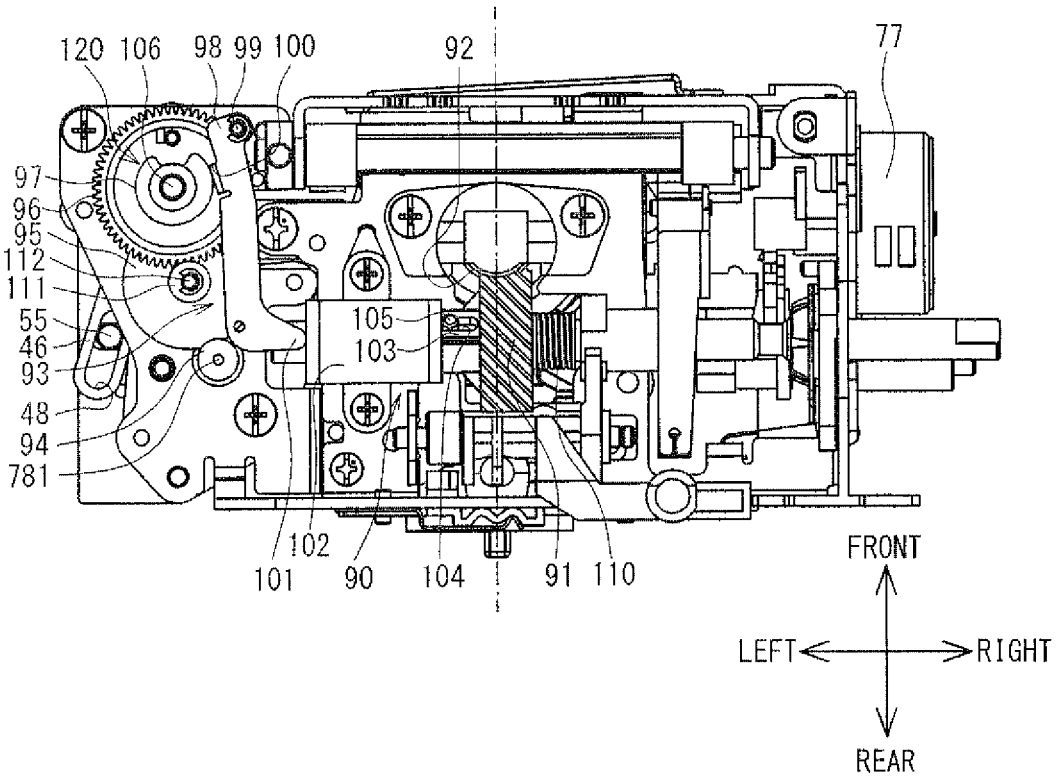
FIG. 10 is a bottom view showing the rotation speed adjustment mechanism when the needle bar is in the right baseline position.

FIG. 4 shows the rotation speed adjustment mechanism 90 when the needle bar 29 is in the left baseline position. FIG. 7 shows the rotation speed adjustment mechanism 90 when the needle bar 29 is in the center baseline position. FIG. 10 shows the rotation speed adjustment mechanism 90 when the needle bar 29 is in the right baseline position. When the needle bar 29 is in the left baseline position, the rotation angle of the first cam member 97 is A2 (refer to FIG. 5). When the needle bar 29 is moved from the left baseline position to the center baseline position, the actuator 78 is driven and the rotation shaft 106 is rotated counterclockwise in a plan view. Accordingly, the first cam member 97 is rotated clockwise in a bottom view. In this case, as shown in FIG. 5, as the rotation angle decreases from A2, the amount of displacement of the first cam member 97 increases. Thus, the first link member 93 is swung in the right direction, and the lower shaft gear 91 pressed by the first link member 93 is moved in the right direction (refer to FIG. 7). As described above, the direction in which the teeth of the lower shaft gear 91 and the shuttle gear 92 are twisted is the clockwise direction. Therefore, when the lower shaft gear 91 is moved by a predetermined distance in the right direction, the rotation speed of the outer shuttle 22 is reduced by a predetermined amount. At this time, the rotation angle of the first cam member 97 is A3 (refer to FIG. 5), which is at the center of the first range.

When the needle bar 29 is moved from the center baseline position to the right baseline position, the rotation shaft 106 is rotated counterclockwise in a plan view. Therefore, the first cam member 97 is rotated clockwise in a bottom view. In this case, as shown in FIG. 5, as the rotation angle decreases from A3, the amount of displacement of the first cam member 97 increases. Thus, the first link member 93 is swung in the right direction, and the lower shaft gear 91 pressed by the first link member 93 is moved by the predetermined distance in the right direction (refer to FIG. 10). As described above, when the lower shaft gear 91 moves in the right direction, the rotation speed of the outer shuttle 22 is further reduced by the predetermined amount. At this time, the rotation angle of the first cam member 97 is A1 (refer to FIG. 5).

In a similar manner, when the needle bar 29 is moved from the left baseline position to a position other than the center baseline position and the right baseline position, the rotation shaft 106 is rotated counterclockwise in a plan view by an amount corresponding to the position of the needle bar 29 in the left-right direction. As a result, the lower shaft gear 91 is moved in the right direction by a distance corresponding to the rotation amount of the rotation shaft 106. As described above, when the lower shaft gear 91 is moved in the right direction, the rotation speed of the outer shuttle 22 is reduced by an adjustment amount corresponding to the movement amount of the lower shaft gear 91. As the position of the needle bar 29 in the left-right direction is separated farther from the left baseline position, each of the rotation amount of the rotation shaft 106, the movement amount of the lower shaft gear 91, and the adjustment amount of the rotation speed of the outer shuttle 22 becomes larger in comparison to a case in which the needle bar 29 is close to the left baseline position, and becomes maximum when the needle bar 29 is in the right baseline position. When the needle bar 29 is moved from a position other than the left baseline position to the left baseline position, the above operation is performed in reverse.

Figure 6:
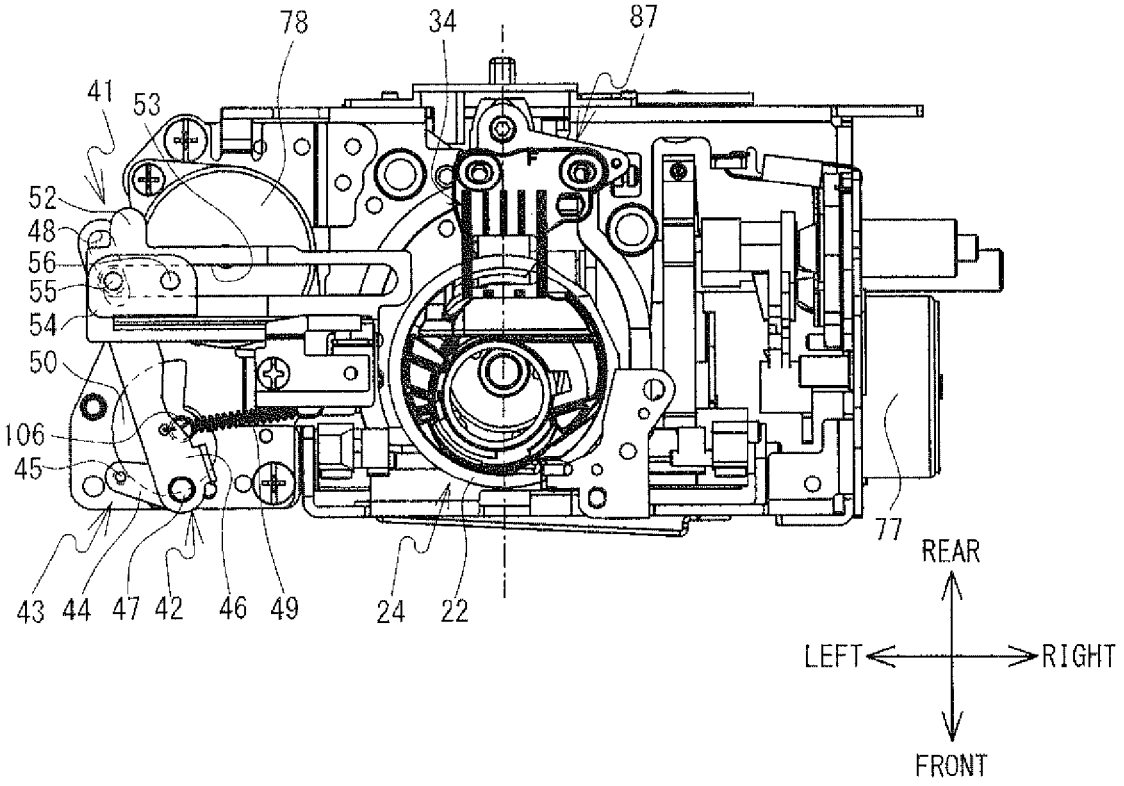
FIG. 6 is a plan view showing the horizontally rotating shuttle and the thread cutting mechanism when the needle bar is in a center baseline position.

When the driving range of the actuator 78 is the first range, the amount of displacement of the second cam member 50 does not change, as shown in FIG. 5. Therefore, as shown in FIGS. 3, 6 and, 9, the thread cutting mechanism 41 does not operate.

Figure 8:
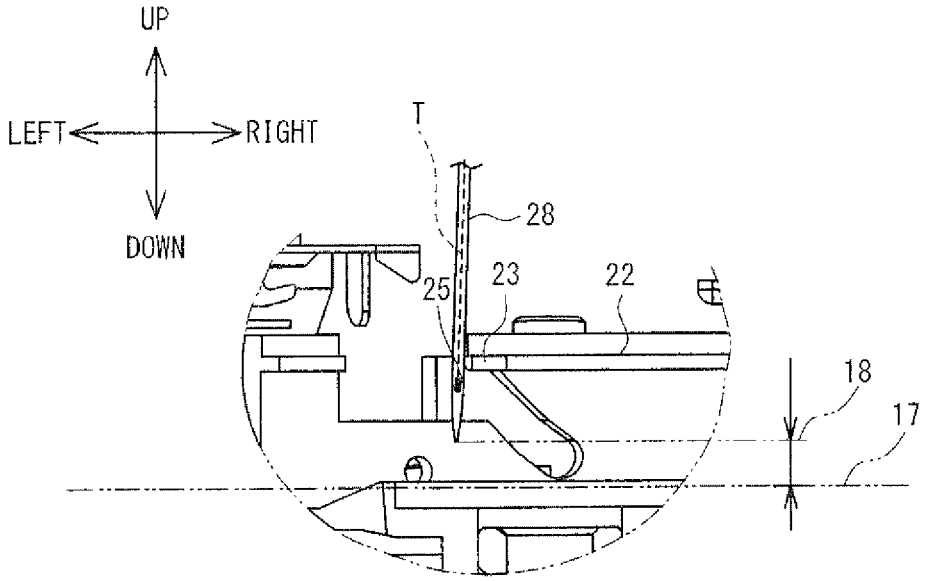
FIG. 8 is a diagram showing positions of a sewing needle and a hook point at an encounter timing.
Figure 9:
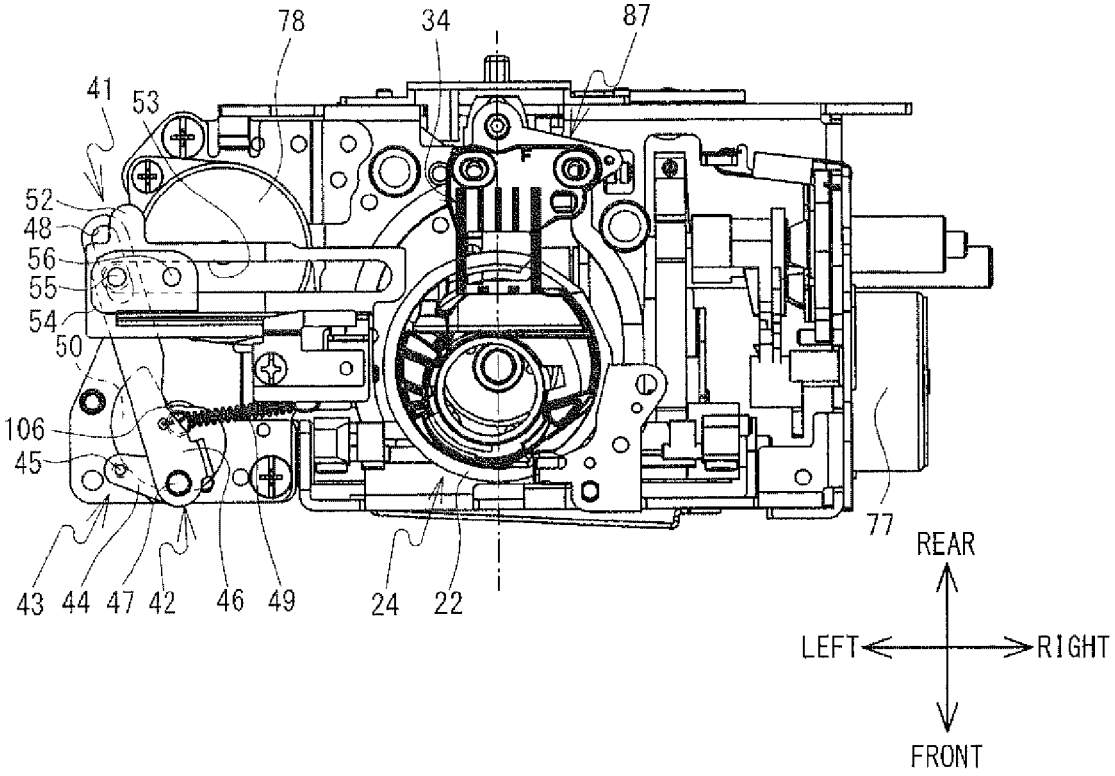
FIG. 9 is a plan view showing the horizontally rotating shuttle and the thread cutting mechanism when the needle bar is in a right baseline position.

A positional relationship between the sewing needle 28 and the hook point 23 at an encounter timing of the sewing needle 28 and the hook point 23 when the driving range of the actuator 78 is the first range will be explained with reference to FIG. 8. FIG. 8 shows a case in which the needle bar 29 is in the left baseline position. The encounter of the sewing needle 28 and the hook point 23 means that the sewing needle 28 is aligned with the leading end (the left end) of the hook point 23 in a front view when the needle bar 29 is moved upward from a lowermost position. A point in time at which the sewing needle 28 encounters the hook point 23 during the operation of the sewing machine 1 is referred to as the encounter timing. The size of the upper thread loop at the encounter timing, namely, the size of the upper thread loop that is formed at the eye 25 of the sewing needle 28, is determined corresponding to the amount of upward movement of the needle bar 29 from the lowermost position. When the amount of upward movement of the needle bar 29 is small, the upper thread loop is small, and when the amount of upward movement of the needle bar 29 is large, the upper thread loop is large. When the upper thread loop is too small, there is a possibility that the hook point 23 cannot catch the upper thread loop. On the other hand, when the upper thread loop is too large, the upper thread loop may deform easily. When the upper thread loop deforms, also in this case, there is a possibility that the hook point 23 cannot catch the upper thread loop. When the hook point 23 cannot catch the upper thread loop, stitch skipping occurs in which stitches are not formed, resulting in imperfect stitching. Therefore, it is preferable that the size of the upper thread loop at the encounter timing is an appropriate size.

The amount of upward movement of the needle bar 29 will be specifically explained. In FIG. 8, the leading end (the lower end) position of the sewing needle 28 when the needle bar 29 is in its lowest position is shown by a horizontal line 17, and the leading end position of the sewing needle 28 when the sewing needle 28 and the hook point 23 are at the encounter timing is shown by a horizontal line 18. In other words, the distance between the horizontal line 17 and the horizontal line 18 is the amount of upward movement of the needle bar 29. The hook point 23 is rotated counterclockwise in a plan view. Therefore, in FIG. 8, the hook point 23 is moved from the right to the left. That is, due to the structure of the horizontally rotating shuttle 24, when the needle bar 29 is in the right baseline position or the center baseline position, the encounter timing of the sewing needle 28 and the hook point 23 is earlier than when the needle bar 29 is in the left baseline position.

As described above, the straight stitches are sewn in the left baseline position. Therefore, the sewing machine 1 appropriately sets the encounter timing in the left baseline position. However, when the encounter timing in the left baseline position is appropriately set, the encounter timing is earlier in the right baseline position or the center baseline position, as described above. Therefore, when the needle bar 29 is in the right baseline position or the center baseline position, the amount of upward movement of the needle bar 29 is small and the upper thread loop is small in comparison to when the needle bar 29 is in the left baseline position. For that reason, particularly in the right baseline position, the amount of upward movement of the needle bar 29 is smaller than that in the center baseline position, and therefore, stitch skipping is more likely to occur.

The amount of upward movement of the needle bar 29 will be specifically explained. In a case where it is assumed that the amount of upward movement of the needle bar 29 in the left baseline position is 3 mm, for example, the amount of upward movement of the needle bar 29 in the center baseline position may be 2 mm, and the amount of upward movement of the needle bar 29 in the right baseline position may be 1 mm. The size of the upper thread loop is a size corresponding to the amount of upward movement of the needle bar 29. However, the sewing machine 1 of the present embodiment uses the rotation speed adjustment mechanism 90 to cause the rotation shaft 106 to rotate by an amount corresponding to the position of the needle bar 29 in the left-right direction, and adjusts the rotation speed of the outer shuttle 22 with respect to the lower shaft 82. That is, the sewing machine 1 uses the rotation speed adjustment mechanism 90 to adjust the rotation speed of the outer shuttle 22, and delays the encounter timing so that the amount of upward movement of the needle bar 29 in a position other than the left baseline position (the position including the right baseline position and the center baseline position) is close to 3 mm. Thus, the sewing machine 1 makes it possible for the hook point 23 to reliably catch the upper thread loop, regardless of which needle drop position the needle bar 29 is in. Therefore, the sewing machine 1 can reliably inhibit the occurrence of stitch skipping.

As described above, the rotation speed adjustment mechanism 90 is driven such that the rotation angle and the rotation amount of the first cam member 97 is different corresponding to the baseline position of the needle bar 29. In other words, the actuator 78 is controlled by a CPU 61, which will be described below, such that the rotation angle and the rotation amount is different corresponding to the baseline position of the needle bar 29.

On the other hand, when the driving range of the actuator 78 is the second range, the first cam member 97 does not move the first link member 93, and the second cam member 50 moves the second link member 42. That is, the rotation speed adjustment mechanism 90 does not operate, and the thread cutting mechanism 41 is moved to the thread catching position and catches the upper thread and the lower thread. After that, the thread cutting mechanism 41 is moved to the cutting position and cuts the upper thread and the lower thread.

Figure 11:
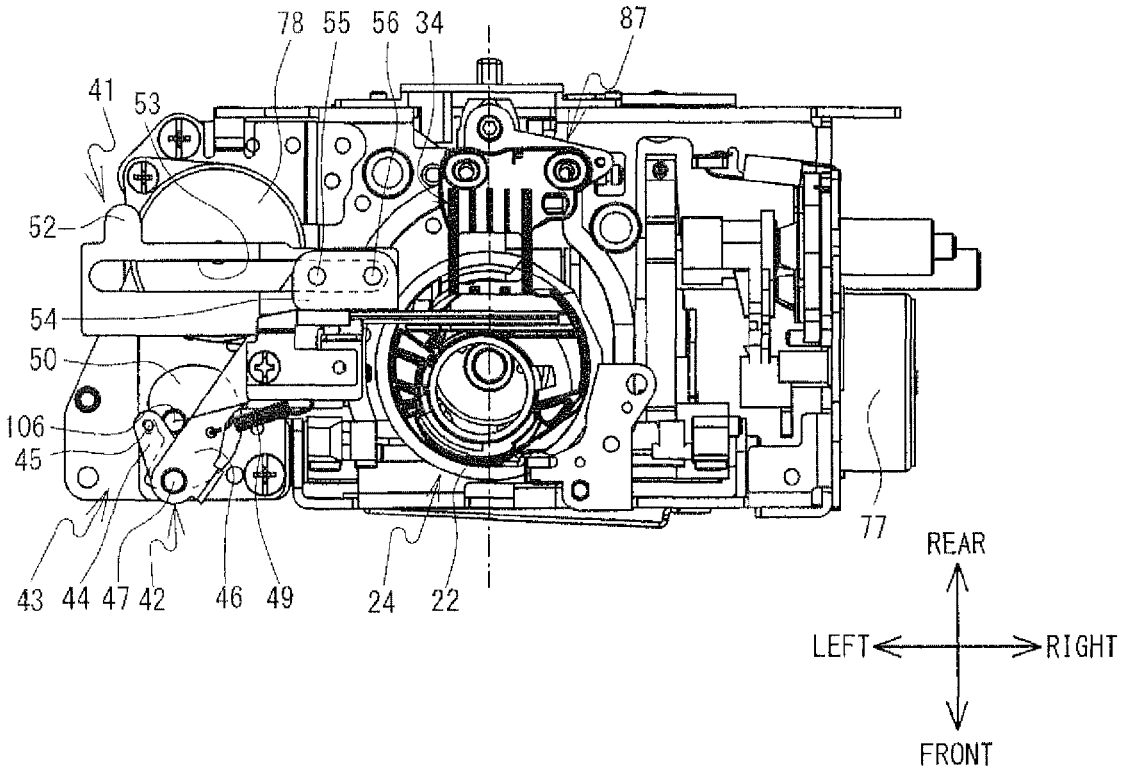
FIG. 11 is a plan view showing the thread cutting mechanism when a thread catching member is located in a thread catching position.
Figure 12:
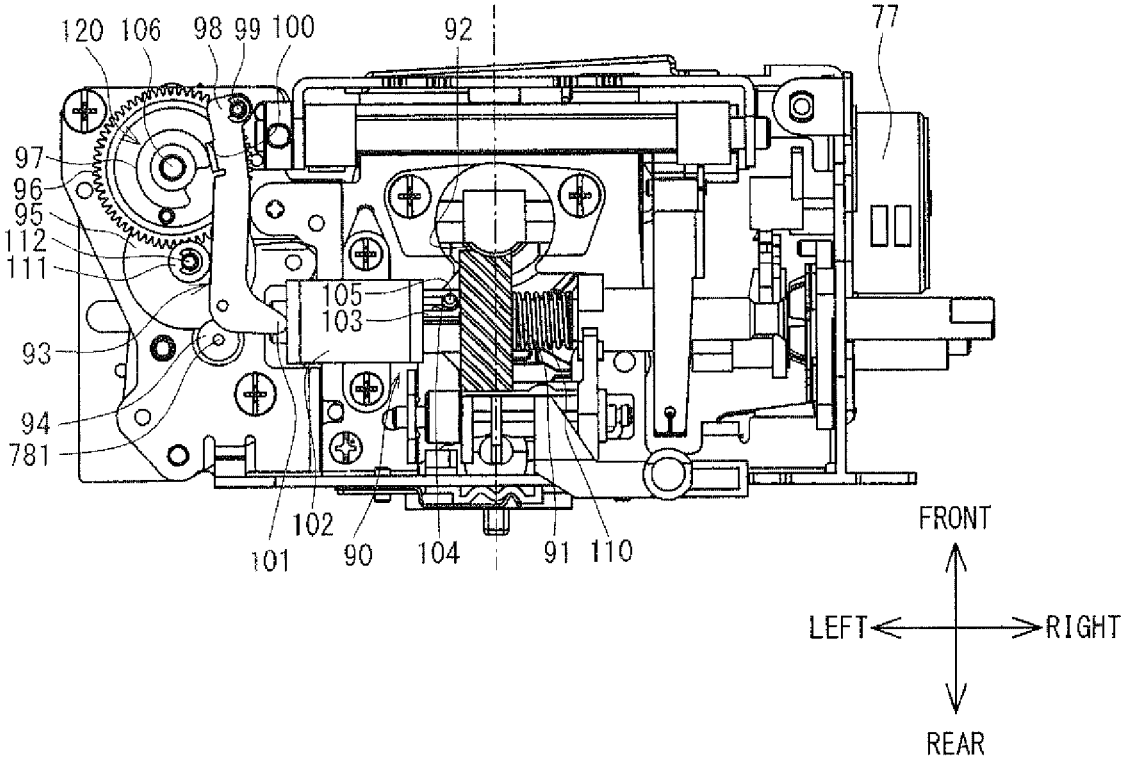
FIG. 12 is a bottom view showing the rotation speed adjustment mechanism when the thread catching member is in the thread catching position.

Next, an operation in which the thread catching member 54 is moved reciprocatingly between the standby position shown in FIG. 3 and the thread catching position shown in FIG. 11 will be explained. As shown in FIG. 5, when the driving range of the actuator 78 is the second range, even if the first cam member 97 is rotated, the amount of displacement of the first cam member 97 does not change. Therefore, the rotation speed adjustment mechanism 90 does not operate.

When the driving range of the actuator 78 is the second range, if the second cam member 50, which is firmly fixed to the rotation shaft 106, is rotated clockwise in a plan view, the amount of displacement of the second cam member 50 decreases. The second link member 42 is urged to the right by the elastic member 49. Accordingly, when the amount of displacement of the second cam member 50 decreases, the second link member 42 is moved (swung) in the clockwise direction around the rotation shaft 47. Along with this, the guide pin 55, which are inserted through the long hole 48 of the second link member 42, and the thread catching member 54 are guided by the long hole 53 of the guide member 52, and are moved to the right. In this manner, the second link member 42 is swung corresponding to the rotation angle of the second cam member 50. Thus, the thread catching member 54 is moved to the thread catching position shown in FIG. 11. After that, the thread catching member 54 is stopped for a predetermined time period in the thread catching position. If the hook point 23 (refer to FIG. 8) is rotated counterclockwise in a plan view during the stopped period, the upper thread hooked by the hook point 23 is moved to a leading end portion of the thread catching member 54 and is caught by the catching portion 51.

After that, when the rotation shaft 106 is rotated counterclockwise in a plan view from the state in which the thread catching member 54 is in the thread catching position, the thread catching member 54 is moved to the standby position shown in FIG. 3. Specifically, when the second cam member 50 is rotated counterclockwise in a plan view, the amount of displacement of the second cam member 50 gradually increases. As the amount of displacement of the second cam member 50 increases, the thread catching member 54 is moved from the thread catching position to the standby position in a state in which the thread catching member 54 has caught the upper thread. During this movement, the lower thread (not shown in the drawings) is caught by the catching portion 51. As described above, the cutting blade (not shown in the drawings) is firmly fixed to the right end portion on the front side of the guide member 52. The upper thread and the lower thread that have been caught by the catching portion 51 of the thread catching member 54 come into contact with the cutting blade such that the upper thread and the lower thread intersect the cutting blade, and are cut in the cutting position, which is in the middle of the movement of the thread catching member 54 to the standby position.

Figure 13:
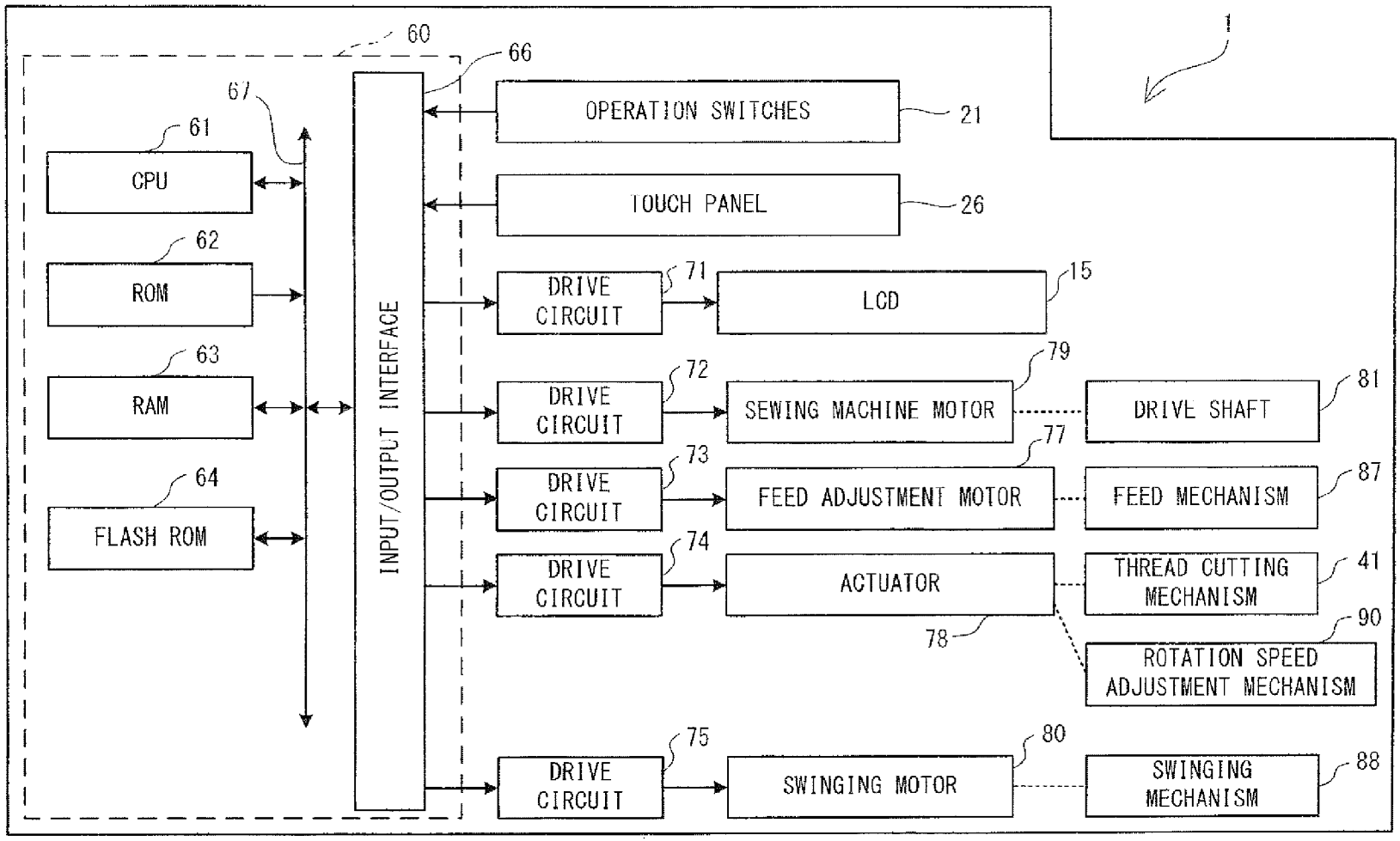
FIG. 13 is a block diagram showing an electrical configuration of the sewing machine.

An electrical configuration of the sewing machine 1 will be explained with reference to FIG. 13. A control portion 60 of the sewing machine 1 includes the CPU 61, a ROM 62, a RAM 63, a flash ROM 64, and an input/output interface 66. The CPU 61, the ROM 62, the RAM 63, the flash ROM 64, and the input/output interface 66 are electrically connected to each other via a bus 67. The ROM 62 stores various programs including a program for the CPU 61 to execute main processing (which will be described below), data, and the like. The flash ROM 64 stores various parameters etc. for the CPU 61 to drive the actuator 78.

The operation switches 21, the touch panel 26, and drive circuits 71 to 75 are electrically connected to the input/output interface 66. The drive circuits 71 to 75 respectively drive the LCD 15, the sewing machine motor 79, the feed adjustment motor 77, the actuator 78, and the swinging motor 80.

When the CPU 61 performs processing that changes the position of the needle bar 29 in the left-right direction, the CPU 61 controls the drive circuit 75 to drive the swinging motor 80. Thus, the swinging mechanism 88 operates and changes the position of the needle bar 29 in the left-right direction. The CPU 61 adjusts the position of the needle bar 29 in the left-right direction by a driving amount of the swinging motor 80. The CPU 61 controls the drive circuit 74 as well as controlling the drive circuit 75, and causes the actuator 78 to operate in the first range. Thus, the rotation speed adjustment mechanism 90 operates and the rotation speed of the outer shuttle 22 is adjusted. At this time, the thread cutting mechanism 41 does not operate. The CPU 61 determines the adjustment amount of the rotation speed of the outer shuttle 22 corresponding to the position of the needle bar 29 in the left-right direction, and adjusts the rotation speed of the outer shuttle 22 based on a driving amount of the actuator 78. The adjustment amount of the rotation speed of the outer shuttle 22 may be determined by any method, such as, for example, by referring to a data table in which the driving amount of the actuator 78 is stored in advance corresponding to the left-right position of the needle bar 29.

When the CPU 61 performs processing that cuts the upper thread and the lower thread, the CPU 61 controls the drive circuit 74 and causes the actuator 78 to operate in the second range. Thus, the rotation speed adjustment mechanism 90 does not operate. The thread cutting mechanism 41 is moved to the cutting position, after moving from the standby position to the thread catching position.

The sewing machine 1 of the present embodiment uses the rotation speed adjustment mechanism 90 to adjust the rotation speed of the outer shuttle 22 corresponding to the position of the needle bar 29 in the left-right direction. When straight stitches are formed, the position of the needle bar 29 in the left-right direction is fixed. Therefore, the outer shuttle 22 rotates at a constant speed. On the other hand, when zigzag stitches are formed, the position of the needle bar 29 in the left-right direction changes. Therefore, the rotation speed of the outer shuttle 22 is adjusted by the rotation speed adjustment mechanism 90. In the present embodiment, when the needle bar 29 is not in the left baseline position, for example, when the needle bar 29 is in the center baseline position or the right baseline position, the encounter timing is adjusted. Therefore, regardless of which needle drop position the needle bar 29 is in, the upper thread loop has an appropriate size and the hook point 23 can hook and catch the upper thread loop. The rotation speed adjustment mechanism 90 uses the common driving source with the thread cutting mechanism 41. Therefore, the sewing machine 1 can adjust the rotation speed of the outer shuttle 22 with respect to the rotation speed of the lower shaft 82 without complicating the structure of the sewing machine 1. In other words, without increasing the size and cost of the sewing machine 1, the sewing machine 1 can improve the encounter timing of the sewing needle 28 and the hook point 23 of the outer shuttle 22, regardless of which needle drop position the needle bar 29 is in.

The rotation speed adjustment mechanism 90 has a relatively simple structure that includes the lower shaft gear 91, the shuttle gear 92 and the first transmission mechanism 120. The sewing machine 1 performs relatively simple driving control in which the lower shaft gear 91 is moved in the axial direction corresponding to the position of the needle bar 29 in the left-right direction. Thus, the sewing machine 1 can adjust the rotation speed of the outer shuttle 22 with respect to the rotation speed of the lower shaft 82. The first transmission mechanism 120 can move the lower shaft gear 91 in the left-right direction using a relatively simple structure, namely, the first cam member 97 and the first link member 93.

The thread cutting mechanism 41 has a relatively simple structure, namely, the thread catching member 54 and the second transmission mechanism 43. The sewing machine 1 can cut the upper thread and the lower thread by performing relatively simple driving control in which the thread catching member 54 is moved between the thread catching position and the cutting position. The second transmission mechanism 43 can move the thread catching member 54 using a relatively simple structure, namely, the second cam member 50 and the second link member 42.

The sewing machine 1 can drive the rotation speed adjustment mechanism 90 by setting the driving range of the actuator 78 to the first range. The sewing machine 1 can drive the thread cutting mechanism 41 by setting the driving range of the actuator 78 to the second range. The first range and the second range of the present embodiment are ranges that are different from each other. Therefore, the sewing machine 1 can drive only the rotation speed adjustment mechanism 90 by setting the driving range of the actuator 78 to the first range. The sewing machine 1 can drive only the thread cutting mechanism 41 by setting the driving range of the actuator 78 to the second range.

The sewing machine of the present disclosure is not limited to the above-described embodiment and various modifications may be made without departing from the spirit and scope of the present disclosure. For example, the following modifications (A) to (C) may be made as appropriate.

(A) The structure of the sewing machine 1 may be changed as appropriate. The sewing machine 1 may be another sewing machine, such as an industrial sewing machine or a multi-needle sewing machine. For example, it is sufficient that the thread cutting mechanism is configured to cut at least the upper thread using an actuator as a driving source, and a known thread cutting mechanism may be adopted as appropriate.

It is sufficient that the rotation speed adjustment mechanism is configured to adjust the rotation speed of the outer shuttle corresponding to the position of the needle bar in the left-right direction, using the actuator as a driving source. Each of the structures of the first transmission mechanism 120 and the second transmission mechanism 43 may be changed as appropriate. Although in the above-described embodiment, the straight stitches are sewn in the left baseline position, the straight stitches may be sewn in the center baseline position or the right baseline position.

Figure 14:
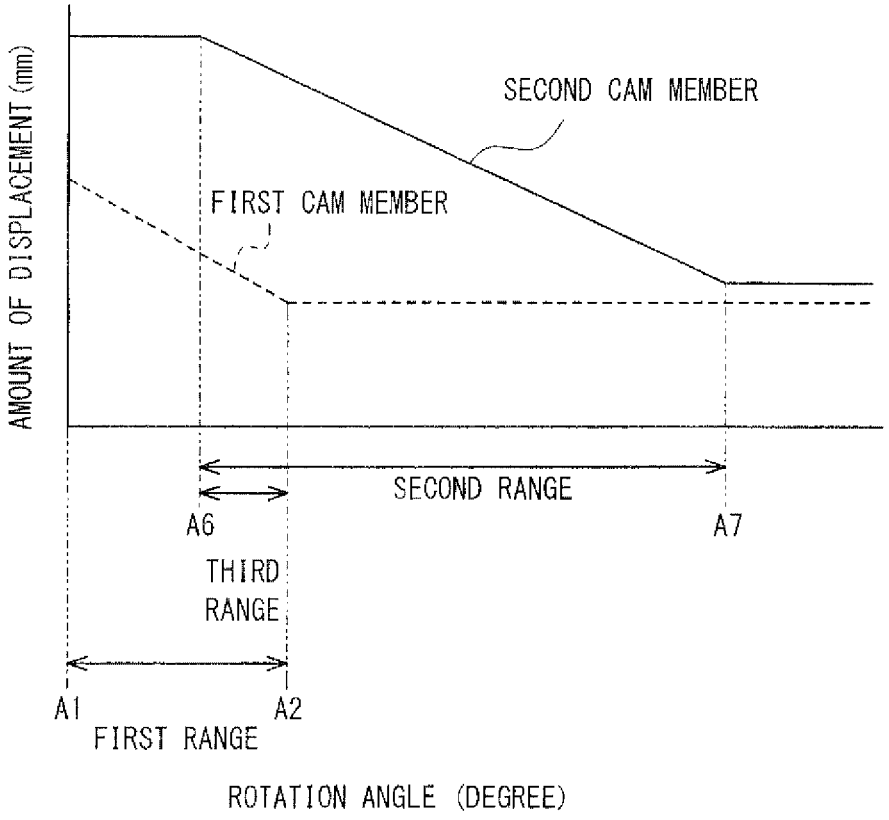
FIG. 14 is a graph schematically showing a relationship between the displacement amount and the rotation angle of the first cam member and the second cam member according to a modified example.

(B) It is sufficient that the driving range of the actuator includes the first range and the second range which is different from the first range or which partially overlaps with the first range. In the above-described embodiment, the first range and the second range are ranges that are different from each other. However, the first range may partially overlap with the second range. In this case, as shown in FIG. 14, a part in which the first range overlaps with the second range is referred to as a third range. When the driving range of the actuator is an area of the first range apart from the third range, the rotation angle is in a range of A1 to A6. In this case, the first cam member moves the first link member, and the second cam member does not move the second link member. When the driving range of the actuator is the third range, the rotation angle is in a range of A6 to A2. In this case, the first cam member moves the first link member and the second cam member moves the second link member. When the driving range of the actuator is an area of the second range apart from the third range, the rotation angle is in a range of A2 to A7. In this case, the first cam member does not move the first link member, and the second cam member moves the second link member. The sewing machine in this case can drive only the rotation speed adjustment mechanism by setting the driving range of the actuator to the area of the first range apart from the third range. The sewing machine can drive both the rotation speed adjustment mechanism and the thread cutting mechanism by setting the driving range of the actuator to the third range. The sewing machine can drive only the thread cutting mechanism by setting the driving range of the actuator to the area of the second range apart from the third range.

(C) It is sufficient that the program and the data to control the actuator 78 are stored in a storage device included in the sewing machine 1 until the sewing machine 1 executes the program. Therefore, the acquisition method and the acquisition path of the program and the data, and the device that stores the program may each be changed, as appropriate. The programs and the data executed by a processor (the CPU 61, for example) included in the sewing machine 1 may be received from another device via a cable or wireless communication, and may be stored in a storage device, such as a flash memory. Examples of the other device include a personal computer (PC) and a server that is connected via a network.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a needle bar that is configured such that a sewing needle is attachable thereto;

a needle bar up-and-down movement mechanism that is configured to move the needle bar up and down;

a swinging mechanism that is configured to swing the needle bar in a left-right direction;

a lower shaft that is configured to rotate in synchronization with up-down movement of the needle bar;

an outer shuttle that is configured to rotate along with rotation of the lower shaft, the outer shuttle including a hook point, the hook point being configured to catch a loop of an upper thread that is passed through an eye of the sewing needle;

a thread cutting mechanism that is configured to cut at least the upper thread;

a rotation speed adjustment mechanism that is configured to adjust a rotation speed of the outer shuttle corresponding to a position of the needle bar in the left-right direction; and an actuator that is a driving source of the thread cutting mechanism and the rotation speed adjustment mechanism;

wherein:

a driving range of the actuator includes a first range and a second range, the actuator being configured to drive the rotation speed adjustment mechanism in the first range, the second range being one of a range that is different from the first range and a range that partially overlaps with the first range, and the actuator being configured to drive the thread cutting mechanism in the second range; and the rotation speed adjustment mechanism includes:

a lower shaft gear that is connected to the lower shaft, the lower shaft gear being a helical gear;

a shuttle gear that is connected to the outer shuttle and that meshes with the lower shaft gear, the shuttle gear being a helical gear; and a first transmission mechanism that is configured to be driven by the actuator, the first transmission mechanism being configured to move the lower shaft gear in an axial direction of the lower shaft.

2. A sewing machine comprising:

a needle bar that is configured such that a sewing needle is attachable thereto;

a needle bar up-and-down movement mechanism that is configured to move the needle bar up and down;

a swinging mechanism that is configured to swing the needle bar in a left-right direction;

a lower shaft that is configured to rotate in synchronization with up-down movement of the needle bar;

an outer shuttle that is configured to rotate along with rotation of the lower shaft, the outer shuttle including a hook point, the hook point being configured to catch a loop of an upper threat that is passed through an eye of the sewing needle;

a thread cutting mechanism that is configured to cut at least the upper thread;

a rotation speed adjustment mechanism that is configured to adjust a rotation speed of the outer shuttle corresponding to a position of the needle bar in the left-right direction; and an actuator that is a driving source of the thread cutting mechanism and the rotation speed adjustment mechanism;

wherein:

the thread cutting mechanism includes:

a thread catching member that is supported to be movable between a thread catching position and a cutting position, the thread catching member being configured to catch at least the upper thread in the thread catching position, and the thread cutting mechanism being configured to cut the upper thread caught by the thread catching member when the thread catching member is in the cutting position; and a second transmission mechanism that is configured to move the thread catching member.

3. The sewing machine according to claim 1, wherein the first transmission mechanism includes:

a first cam member that is configured to rotate by being driven by the actuator; and a first link member that is configured to be in contact with the first cam member, the first link member being configured to move along with rotation of the first cam member and to move the lower shaft gear in the axial direction.

4. The sewing machine according to claim 3, wherein the thread cutting mechanism includes:

a thread catching member that is supported to be movable between a thread catching position and a cutting position, the thread catching member being configured to catch at least the upper thread in the thread catching position, and the thread cutting mechanism being configured to cut the upper thread caught by the thread catching member when the thread catching member is in the cutting position; and a second transmission mechanism that is configured to move the thread catching member, and the second transmission mechanism includes:

a second cam member that is configured to rotate integrally with the first cam member; and a second link member that is configured to be in contact with the second cam member, the second link member being configured to move along with rotation of the second cam member and to move the thread catching member.

5. The sewing machine according to claim 4, wherein the first range and the second range are ranges that are different from each other, the first cam member is configured to move the first link member in response to the driving range of the actuator being the first range and the second cam member is configured not to move the second link member in response to the driving range of the actuator being the first range, and the first cam member is configured not to move the first link member in response to the driving range of the actuator being the second range and the second cam member is configured to move the second link member in response to the driving range of the actuator being the second range.

6. The sewing machine according to claim 4, wherein the first range partially overlaps with the second range, a part in which the first range partially overlaps the second range is a third range, the first cam member is configured to move the first link member in response to the driving range of the actuator being the first range apart from the third range and the second cam member is configured not to move the second link member in response to the driving range of the actuator being the first range apart from the third range, the first cam member is configured to move the first link member in response to the driving range of the actuator being the third range and the second cam member is configured to move the second link member in response to the driving range of the actuator being the third range, and the first cam member is configured not to move the first link member in response to the driving range of the actuator being the second range apart from the third range and the second cam member is configured to move the second link member in response to the driving range of the actuator being the second range apart from the third range.

* * * * *